United States Patent [19]

Blake

[11] Patent Number: 4,877,068

[45] Date of Patent: Oct. 31, 1989

[54] BAG LOADER AND BAG FOR BEVERAGE CANS

[76] Inventor: Gregory L. Blake, 1508 Humphrey, Birmingham, Mich. 48008

[21] Appl. No.: 219,183

[22] Filed: Jul. 15, 1988

[51] Int. Cl.[4] ..... B65B 67/04

[52] U.S. Cl. ..... 141/390; 141/114; 141/391; 294/137; 53/176; 53/590; 53/390; 206/427

[58] Field of Search ..... 141/390, 391, 392, 114, 141/313, 314, 316, 10; 53/590, 176, 244, 255, 264, 540, 585, 390; 221/175; 414/97, 35; 294/137, 165; 248/95; 206/162, 139, 427, 428, 431

[56] References Cited

U.S. PATENT DOCUMENTS

| | | | |
|---|---|---|---|
| 2,874,736 | 2/1959 | Hughes | 141/391 X |
| 3,983,914 | 10/1976 | Benson | 141/390 |
| 4,037,778 | 7/1977 | Boyle | 229/59 |
| 4,290,525 | 9/1981 | Sisson | 206/427 |
| 4,542,826 | 9/1985 | Adams | 206/427 |
| 4,542,930 | 9/1985 | Adams | 294/160 |
| 4,574,978 | 3/1986 | Hodges | 206/247 |
| 4,628,007 | 12/1986 | Ledsham | 141/390 X |
| 4,706,805 | 11/1987 | Becher | 206/427 X |

*Primary Examiner*—Ernest G. Cusick

*Attorney, Agent, or Firm*—Reising, Ethington, Barnard, Perry & Milton

[57] ABSTRACT

A receptacle is provided for the collection and transport of empty beverage cans for return to the store for refund. It comprises a reusable bag loader and a standard paper grocery bag. The loader comprises a cluster of open ended tubes. It is insertable into the bag to receive cans in the predetermined formation of rows and columns of the tubes. It is removable from the bag while the cans remain in the bag for transport thereby to the store.

6 Claims, 2 Drawing Sheets

BAG LOADER AND BAG FOR BEVERAGE CANS

FIELD OF THE INVENTION

This invention relates to a receptacle for empty beverage cans; more particularly it relates to a loading device for loading empty beverage cans into a bag in an orderly array for transport to a store for refund.

BACKGROUND OF THE INVENTION

Since the advent of legislation in certain states requiring a deposit upon certain returnable beverage cans, there has been a need for a simple, low cost device to facilitate collection, transport, and counting of empty cans. Although a great variety of devices have been proposed, this need has remained unsatisfied. Desirably, such a device should comprise a receptacle to facilitate collection and storage of empty cans in a sanitary manner and in a compact space. The receptacle should store the cans in a manner which facilitates counting and in readiness for transport by means which is of low cost and light weight and yet sufficiently durable to endure at least a one-way trip to the store.

In the prior art, a reusable carrier constructed of transparent plastic has been proposed for collecting and transporting empty cans. In this carrier, a rectangular bag is provided with an open top and a plurality of vertically extnding compartments each adapted to receive a plurality of cans stacked on top of each other. This reusable carrier has the disadvantage of being relatively costly and must be transported to and from the store; also, it may eventually become unsanitary as a storage device. This device is disclosed in U.S. Pat. No. 4,542,826 granted Sept. 24, 1985.

A similar reusable carrier device in which the cans are laid on their sides in horizontal tiers is shown in U.S. Pat. No. 4,290,525 granted Sept. 22, 1981. A reusable carrier comprising a vertical array of rigid tubes each adapted to receive plural stacked cans is disclosed in U.S. Pat. No. 4,542,930 granted Sept. 24, 1985. Although not adapted for beverage cans, a bag loader usable for refuse is shown in the Boyle U.S. Pat. No. 4,037,778 granted July 26, 1977. This bag loader comprises plural vertically extending rigid panels and is inserted into a limp plastic bag as a liner to receive the refuse. When it is filled, it is removed leaving the refuse in the bag.

A general object of this invention is to provide an improved bag loader for empty beverage cans which overcomes certain disadvantages of the prior art.

SUMMARY OF THE INVENTION

In accordance with this invention, there is provided an improved receptacle for collection, storage and transport of a predetermined number of beverage cans for reurn to a store for refund. The receptacle comprises a reusable bag loader and a standard size paper grocery bag; the loader is insertable into the bag to receive cans in a predetermined formation of rows and columns and is removable from the bag while the cans remain in the bag for transport thereby to the store.

Further, in accordance with this invention, a bag loader is provided for loading empty cans in the grocery bag. The bag loader comprises a cluster of rigid, vertically extending, can guides with open top and bottom ends. The can guides are arranged in three parallel rows comprising two outer rows and an inner row therebetween with four can guides in each row. Each of the can guides includes means for constraining a can therein to move axially of the can and for defining an axially extending clear space having a length greater than two cans. The two outer rows are spaced from each other with each can guide in one outer row being centered on a line perpendicular to the other outer row. The inner row of can guides is offset from the outer rows along the row direction by one-half of the diameter of the clear space inside a can guide.

Further, in accordance with this invention, a receptacle for beverage cans comprises a bag loader including a cluster of rigid cylindrical, vertically extending, tubes arranged in parallel rows and having open top and bottom ends. There are two outer rows and an inner row therebetween with four tubes in each row. The adjacent tubes in each row are contiguous and the two outer rows are spaced from each other with the tubes of the inner row being nested between adjacent tubes in the outer rows such that the inner row is offset from the outer rows along the row direction by one-half diameter of a tube. Each of the tubes has a diameter slightly larger than a beverage can and a length greater than two cans. The bag loader coacts with a standard paper grocery bag having a rectangular opening slightly smaller in both dimensions than a rectangle circumscribing the cluster of tubes. The bag loader is insertable into the bag and distorts it sufficiently from a rectangular shape to accommodate the nonrectangular shape of the cluster. At least one rubber band is stretched around the girth of the bag. This permits the bag loader to be filled with beverage cans in each tube and to be pulled out of the bag to leave the cans stacked three cans deep in three side-by-side rows.

Further, in accordance with this invention, a platform is provided for supporting the bag with the bag loader thereon in an upright position. A set of four posts are disposed in a rectangular array on the platform with each post being disposed opposite a corner of the bag. The posts are adapted to support one or more rubber bands stretched therearound whereby a rubber band may be removed from the posts and disposed in a stretched condition around the bag before removal of the bag loader.

A complete understanding of this invention may be obtained from the detailed description that follows taken with the accompanying drawings.

DESCRIPTION OF THE PREFERRED EMBODIMENT(S)

Figure 1:
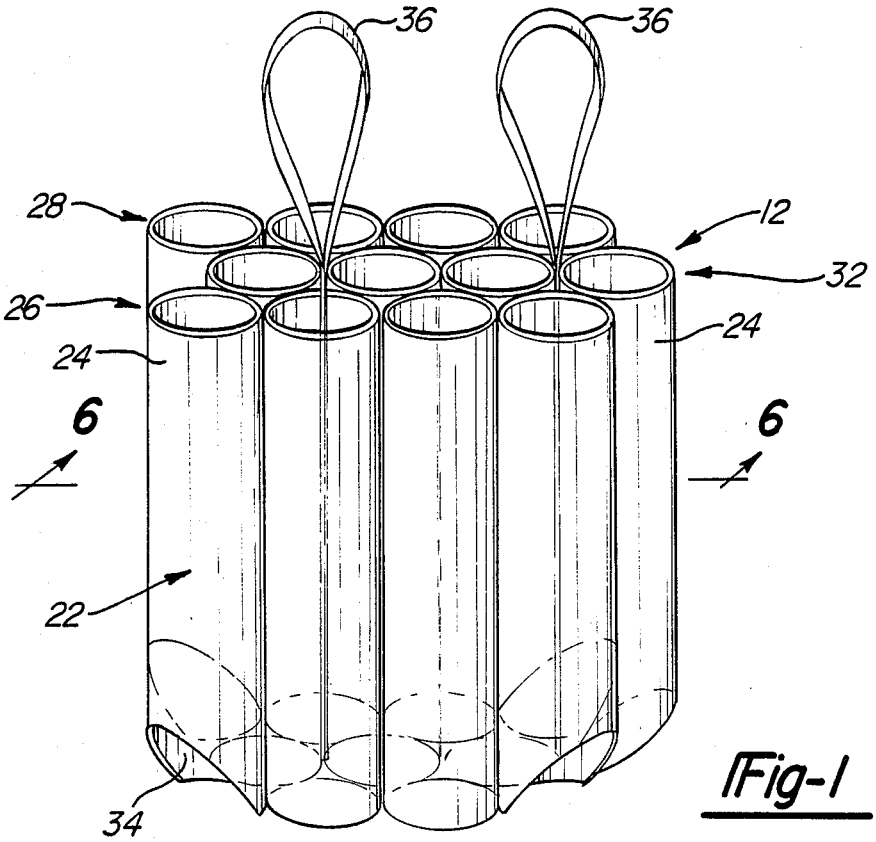
FIG. 1 is a perspective view of the bag loader of this invention.

Before describing the details of implementation of the inventive beveage can receptacle, a general description of the invention with reference to the objectives to be achieved will be given.

In order to meet the needs for collection, storage and return of empty beverage cans, the can receiver or receptacle must be readily available at low cost and compact in space requirements. The need for sanitary storage can be met by stacking the cans upright to prevent leakage. For the purpose of minimizing handling, the receptacle should serve both for collection and storage of the cans as well as transport. To minimize carrying, it should be a throwaway item after a one-way trip to the store. Counting of cans both at home and at the store can be facilitated by storage and transport of the cans in a formation of rows and columns. Subject to a major problem, all of the above-mentioned objectives can be met by the use of common household item—a conventional standard size grocery bag. The problem is that it is almost impossible for one person to load a paper bag by hand with empty cans stacked in a formation of rows and columns.

As discussed above, the conventional grocery bag is admirably suited for use as a carrier for empty beverage cans but to make it successful, a device for facilitating loading of the bag is required. The loading device should facilitate loading in the formation of rows and columns but a separate device fitted into each bag would be expensive. Instead, such a device should be reusable from one bag to another. On the other hand, a reusable loading device in the bag which must be carried to the store and from the store for repeated use would not be conducive to use of the loading device. This leads to the concept of a bag loader which is insertable into a bag for loading and then once the bag is loaded it should be removable with the cans in a formation of rows and columns left in the bag. Thus, the bag and cans only can be carried to the store; the formation of rows and columns makes it stable for handling and easy to verify the count and the bag can be thrown away.

The most commonly used conventional paper grocery bag is that known as a one-sixth barrel Kraft paper bag. It will readily hold 36 beverage cans of conventional size with the cans standing upright in the bag with the cans stacked in three layers, twelve cans per layer. Each layer has three rows of cans with four cans in each row. The conventional grocery bag when fully opened and standing upright is of rectangular configuration with a horizontal cross-section which is twelve inches long and seven inches wide with a vertical dimension of seventeen inches high.

Beverage cans of twelve ounce capacity are made in two conventional sizes. One size has a diameter of two and one-half inches and a height of five and one-fourth inches. The other size is two and five-eighths inches diameter and four and seven-eighths inches high. With these dimensions, it would seem that a feasible formation of twelve cans per layer would be three rows parallel to the length of the bag and four columns parallel to the width of the bag with some distortion of the bag. Accordingly, a loader for the bag might comprise a cluster of can guides comprising open ended tubes in the rectangular formation of three parallel rows and four columns perpendicular to the rows. The tubular loader would be constructed with a set of twelve tubes contiguous with each other and having a diameter slightly larger than the larger conventional beverage can, i.e. two and five-eighths inches. Each tube must have a wall thickness say, one-sixteenth of an inch, sufficient to give the cluster of tubes sufficient rigidity to be self-supporting. The problem with this is that if the tubes are disposed in a rectangular array, the cluster formation of the bag loader is considerably wider than the width of the bag. As a result, the cans do not hold the formation of the can loader after it is removed. Instead, the cans in the upper tiers tend to assume a circular formation while those in the lower tier tend to remain in a rectangular formation. This is an unmanageable arrangement; the bag is hard to carry, it tips over in the trunk of the car and it is hard to verify the count. If the cluster formation of tubes is changed from rectangular the width of the formation can be reduced by offsetting the inner row of tubes by one-half tube diameter, in the direction of the rows, from the outer rows. The width of this is about seven and three-eighths inches which is slightly oversize for the bag. In this formation, however, the overall length of the cluster formation is approximately twelve and three-eighths inches which is oversize for the twelve inch length of the bag.

Nevertheless, and with the full knowledge of the above discussed dimensional relationships and the indications that a bag loader of the required dimensions would not fit the conventional grocery bag, I experimented with different combinations of can guides, materials and sizes in different cluster formations. By reason of factors which were in seeking a solution to the problem, I discovered a bag loader in the form of a tubular can guide cluster which is highly successful for loading a conventional grocery bag with either or both sizes of conventional beverage cans. The preferred embodiment of the invention will now be described in detail.

Referring now to the drawings, there is shown an illustrative embodiment of the invention in a receptacle for returnable beverage cans of standard size comprising a special bag loader adapted for use with a standard size paper grocery bag.

Figure 2:
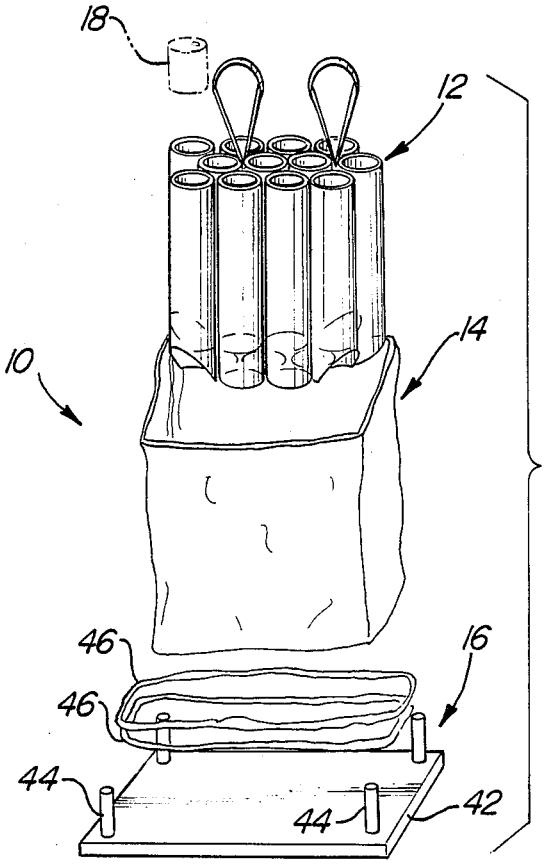
FIG. 2 is a perspective, exploded view of the beverage can receptacle of this invention, including the bag loader.
Figure 3:
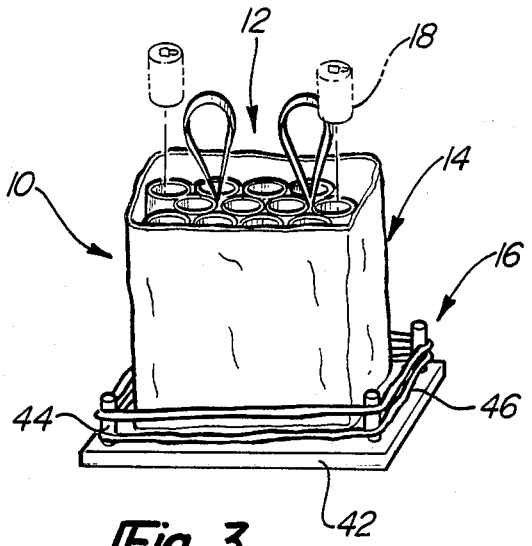
FIG. 3 shows the receptacle in a partially loaded condition.

As shown in FIGS. 1, 2 and 3, the beverage can receptacle 10 of this invention comprises, in general, a bag loader 12 adapted to be inserted into a grocery bag 14 with the bag supported on a loading platform 16. The bag 14 is a standard grocery bag of the type and dimensions described above. Such a bag has sufficient stiffness so that when it is in its opened position it is capable of standing erect without support. It is sufficiently flexible that it may be distorted from its rectangular configuration by relatively small forces so that it can be made to conform to configurations other than rectangular. The receptacle also includes one or more rubber bands 46 for girding the bag. The rubber bands should be a #33 or exert the same clamping force as that known in the trade as a #33 rubber band. The receptacle 10 is adapted to receive thirty-six beverage cans 18 of conventional size as discussed above.

The bag loader 12 comprises a cluster 22 of twelve can guides in the form of cylindrical tubes 24. Each of the tubes is open at both the top end and the bottom end. All of the tubes are of the same diameter and wall thickness and are of the same overall length. Each tube 24 has an inside diameter of approximately two and three-fourths inches and an outside diameter of two and seven-eighths inches with a length of approximately fifteen inches. The length is not critical but for a stack which is three cans high it must be greater than the height of two cans in order to contain at least part of the upper tier of cans.

Figure 6:
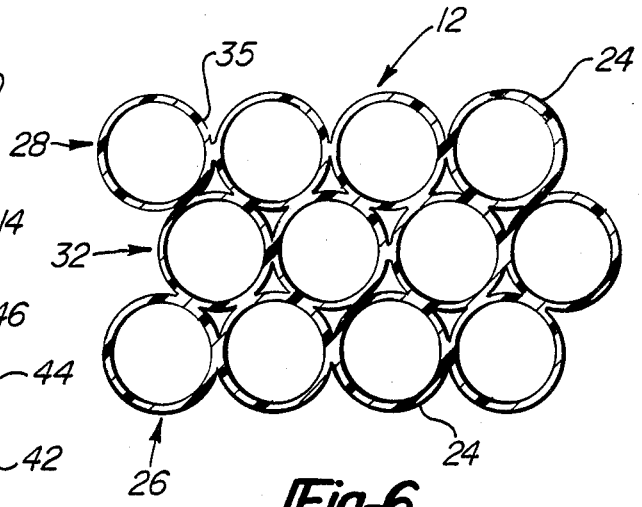
FIG. 6 is a view of the bag loader taken on lines 6—6 of FIG. 1.

The cluster 22 of the twelve tubes 24 is arranged in three parallel rows, namely outer rows 26 and 28 and an inner row 32, with four tubes in each row. The inner row 32 is offset along the row direction by one-half tube diameter from the tubes in the outer rows 26 and 28. Each tube in the outer row 26 is centered on a line perpendicular to the other outer row 28. Each tube in the inner row 32 is nested and contiguous with the adjacent tubes in the outer rows 26 and 28. It is noted that all tubes, except one, in the inner row 32 are contiguous with two tubes in each of the outer rows 26 and 28 and the one tube is contiguous with only one tube in each outer row. The tubes 24 are held in the cluster formation by a suitable adhesive 35, such as epoxy resin, as indicated in FIG. 6. The adhesive is applied along the tangent lines of contiguous tubes in such manner as to provide for engagement of the tubes and the maximum compactness of the cluster. The lower ends of those tubes 24 which are located at the ends of outer rows 26 and 28 and the lower end of that tube at the protruding end of the inner row 32 are provided with bevelled ends 34 to facilitate insertion of the bag loader 12 into the bag 14 and to provide additional roominess for the loader at the lower end. The loader 12 is provided with a pair of handles 36 in the form of flexible straps to facilitate lifting of the bag loader 12 from the bag 14. The tubes 24 are suitably constructed of a plastic material such as polyethylene.

The loading platform 16 comprises a flat base 42 of rectangular configuration somewhat larger than the rectangular base of the open bag 14. The base 42 is provided with a set of four posts 44 disposed in a rectangular array with each post disposed outwardly of the corner of the bag 14. The posts 44 are adapted to support a set of rubber bands 46 in a stretched condition which are to be applied around the bag 14 after it is loaded.

Figure 4:
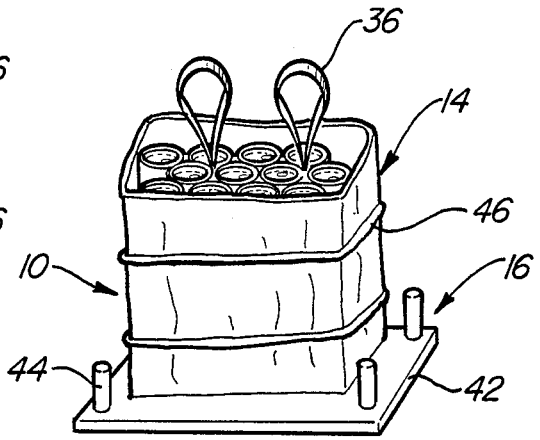
FIG. 4 shows the receptacle loaded with beverage cans.
Figure 5:
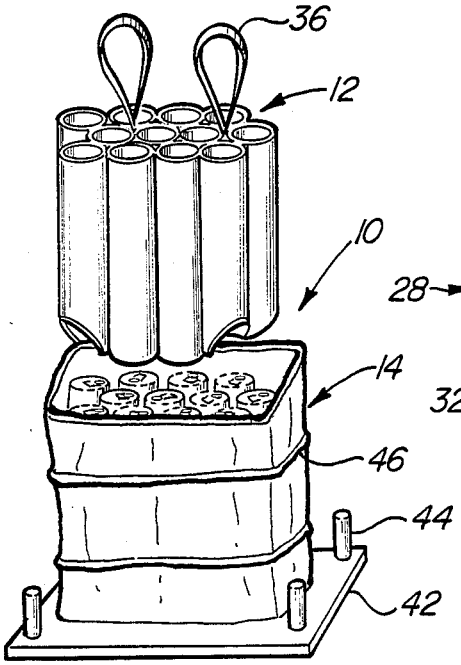
FIG. 5 shows the bag loader being removed from the bag.

The use of the beverage can receptacle 10 will be described with reference to FIGS. 3, 4 and 5. As shown in FIG. 3, the bag loader 12 is in place inside the bag 14 and the bag is resting on the loading platform 16. The loading platform may be suitably disposed on the floor or on a supporting stand of some kind. At any time after the loader 12 is placed in the bag and before it is removed, the rubber bands 46 are stretched around the bag as described below. Empty beverage cans are dropped into any one of the tubes 14 in the loader until the loader is filled as shown in FIG. 4. One of the rubber bands 46 is then removed from the posts 44 and placed around the bag 14 near the mid-portion of the upper tier of cans. Preferably another rubber band 46 from the posts 44 is placed around the bag in the vicinity of either the middle or lower tier of cans. The rubber bands are selected to have an unstretched length smaller than the periphery of the three rows of cans so that the rubber band will exert a clamping force through the bag and against the cans to hold them in the formation of rows. The desired clamping force is provided by a #33 rubber band. Excessive force prevents the loader from sliding easily out of the bag and may rearrange the can formation. Then, the bag loader 12, as shown in FIG. 5, is lifted from the bag 14 leaving the beverage cans in place in the bag. In this condition, the bag full of cans is easy to handle and to carry to the store for counting and refund. The bag loader 12, after removal, is ready for use with another empty bag.

Although the description of this invention has been given with reference to a particular embodiment, it is not to be construed in a limiting sense. Many variations and modifications will now occur to those skilled in the art. For a definition of the invention reference is made to the appended claims.

What is claimed is:

1. A receptacle for empty beverage cans comprising:

a bag loader comprising a cluster of rigid cylindrical, vertically extending, tubes all having the same diameter with open top and bottom ends, said tubes being arranged in three parallel rows comprising two outer rows and an inner row therebetween with four tubes in each row, the adjacent tubes in each row being contiguous, the two outer rows being spaced from each other with each tube in one outer row being centered on a line perpendicular to the other outer row, the inner row of tubes being offset from the outer rows along the row direction by one-half diameter of a tube with each tube thereof nested and contiguous with adjacent tubes in the outer rows, each of the tubes having a diameter slightly larger than a beverage can and a length greater than two cans, and means for holding said tubes in said cluster, a standard paper grocery bag of one-sixth barrel size having a rectangular opening slightly smaller in both dimensions than a rectangle circumscribing said cluster, said bag loader being inserted into said bag with said bag distorted sufficiently from a rectangular shape to accommodate the nonrectangular shape of said cluster, a rubber band adapted to be stretched around said bag, whereby beverage cans may be stacked in each tube and the bag loader may be pulled out of said bag to leave said cans stacked in rows.

2. The invention as defined in claim 1 wherein the lower ends of the tubes disposed on the corners of said bag loader are bevelled to facilitate the insertion of the bag loader into said bag.

3. The invention as defined in claim 2 including:

a handle connected with said bag loader for pulling it out of said bag.

4. The invention as defined in claim 1 including:

a platform including a set of four posts disposed in a rectangular array, said bag being supported in an upright position on said platform, each of said posts being disposed opposite a corner of said bag, said array of posts being adapted to support said rubber band stretched therearound, whereby said rubber band may be manually removed from said posts and disposed in stretched condition around said bag after removal of said bag loader to hold the cans in a formation of rows in said bag.

5. A receptacle for empty beverage cans of cylindrical shape comprising:

a bag loader comprising a cluster of rigid, vertically extending, can guides with open top and bottom ends, said can guides being arranged in three parallel rows comprising two outer rows and an inner row therebetween with four can guides in each row, the two outer rows being spaced from each other with each can guide in one outer row now being centered on a line perpendicular to the other outer row, the inner row of can guides being offset from the outer rows along the row direction by one-half of the width of a can guide measured in the row direction, each of the can guides including means for constraining a can therein to move axially with respect to said can, without substantial lateral movement of said can within said can guide, and defining an axially extending clear space having a length greater than two cans, and a bag having an opening large enough to permit insertion of said bag loader and having a depth substantially the same as the axial length of said loader, said bag loader being disposed inside said bag and seated on the bottom thereof.

6. A receptacle for empty beverage cans comprising:

a bag loader comprising a cluster of rigid cylindrical, vertically extending, tubes all having the same diameter with open top and bottom ends, said tubes being arranged in three parallel rows comprising two outer rows and an inner row therebetween with four tubes in each row, the adjacent tubes in each row being contiguous, the two outer rows being spaced from each other with each tube in one outer row being centered on a line perpendicular to the other outer row, the inner row of tubes being offset from the outer rows along the row direction by one-half diameter of a tube with each tube thereof nested and contiguous with adjacent tubes in the outer rows, each of the tubes having a diameter slightly larger than a beverage can and a length greater than two cans, and means for holding said tubes in said cluster, and a standard paper grocery bag of one-sixth barrel size having a rectangular opening slightly smaller in both dimensions than a rectangle circumscribing said bag loader, said bag loader being disposed inside said bag and seated on the bottom thereof.

* * * * *